US009752578B2

(12) United States Patent
Han et al.

(10) Patent No.: US 9,752,578 B2
(45) Date of Patent: Sep. 5, 2017

(54) SCROLL COMPRESSOR AND METHOD FOR ASSEMBLING A SCROLL COMPRESSOR

(71) Applicant: LG ELECTRONICS INC., Seoul (KR)

(72) Inventors: Nara Han, Seoul (KR); Kiuk Lee, Seoul (KR); Kiwon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

(21) Appl. No.: 14/693,946

(22) Filed: Apr. 23, 2015

(65) Prior Publication Data

US 2015/0316053 A1 Nov. 5, 2015

(30) Foreign Application Priority Data

May 2, 2014 (KR) ..... 10-2014-0053653

(51) Int. Cl.
*F04C 18/02* (2006.01)
*F04C 29/00* (2006.01)
*F04C 23/00* (2006.01)

(52) U.S. Cl.
CPC ..... *F04C 18/0223* (2013.01); *F04C 18/0215* (2013.01); *F04C 23/008* (2013.01); *F04C 29/005* (2013.01); *F04C 2240/52* (2013.01); *Y10T 29/49242* (2015.01)

(58) Field of Classification Search
CPC F04C 18/0215; F04C 18/0223; F04C 29/005; F04C 2240/52; F04C 23/008; Y10T 29/49242
See application file for complete search history.

(56) References Cited

U.S. PATENT DOCUMENTS 5,102,316 A * 4/1992 Caillat ..... F01C 1/0215 418/55.5
5,743,720 A * 4/1998 Sano ..... F01C 17/066 418/55.2
6,984,115 B1 1/2006 Tarng et al.
(Continued)

FOREIGN PATENT DOCUMENTS

EP 0 157 390 10/1985
JP 06-026471 2/1994
(Continued)

OTHER PUBLICATIONS

European Search Report dated Oct. 14, 2015.

*Primary Examiner* — Mark Laurenzi
*Assistant Examiner* — Wesley Harris
(74) *Attorney, Agent, or Firm* — KED & Associates, LLP

(57) ABSTRACT

A scroll compressor and a method for assembling a scroll compressor are provided. The scroll compressor may include a casing including a rotational shaft, a main frame coupled to an inside of the casing, a first scroll that revolves due to rotation of the rotational shaft, the first scroll being supported by the main frame, and a second scroll disposed on or at a side of the first scroll to define a plurality of compression chambers together with the first scroll. The second scroll may include a head plate including a wrap, and at least one coupling guide that extends from the head plate. The at least one coupling guide may include a first reference pin coupling hole, into which a reference pin may be inserted, and a guide hole, into which a coupling member may be inserted.

18 Claims, 19 Drawing Sheets

(56) References Cited

U.S. PATENT DOCUMENTS

| | | | | |
|---|---|---|---|---|
| 2005/0019194 | A1* | 1/2005 | Tarng | F01C 17/066<br>418/55.3 |
| 2005/0025652 | A1 | 2/2005 | Kuo | |

FOREIGN PATENT DOCUMENTS

| | | |
|---|---|---|
| JP | 09-032752 | 2/1997 |
| WO | WO 95/20719 | 8/1995 |

* cited by examiner

- RELATED ART -

- RELATED ART -

- RELATED ART -

- RELATED ART -

- RELATED ART -

- RELATED ART -

- RELATED ART -

- RELATED ART -

SCROLL COMPRESSOR AND METHOD FOR ASSEMBLING A SCROLL COMPRESSOR

CROSS-REFERENCE TO RELATED APPLICATION(S)

The present application claims priority under 35 U.S.C. 119 and 35 U.S.C. 365 to Korean Patent Application No. 10-2014-0053653, filed in Korea on May 2, 2014, which is hereby incorporated by reference in its entirety.

BACKGROUND

1. Field

A scroll compressor and a method for assembling a scroll compressor are disclosed herein.

2. Background

A scroll compressor is a compressor that includes a fixed scroll having a spiral wrap, and an orbiting scroll that revolves with respect to the fixed scroll, that is, a compressor in which the fixed scroll and the orbiting scroll are engaged with each other. The orbiting scroll revolves with respect to the fixed scroll, thereby reducing a volume of a compression chamber, which is formed between the fixed scroll and the orbiting scroll according to an orbiting motion of the orbiting scroll, thus increasing a pressure of a fluid, which is then discharged through a discharge hole formed in a central portion of the fixed scroll. Such a scroll compressor has a feature in which suction, compression, and a discharge of a fluid are successively performed while the orbiting scroll revolves. Accordingly, a discharge valve and a suction valve may be unnecessary in principle. Also, as a number of components of the scroll compressor is less in comparison to other types of compressor, the scroll compressor may be simplified in structure and rotate at a high speed. Also, as a variation in torque required for compression is less in comparison to other types of compressor, and suction and compression successively occur, a relatively small amount of noise and vibration may occur.

One important issue in scroll compressors is leakage and lubrication between the fixing scroll and the orbiting scroll. That is, to prevent a refrigerant from leaking between the fixed scroll and the orbiting scroll, an end of a wrap has to be closely attached to a surface of a head plate to prevent compressed refrigerant from leaking. The term "head plate" may be refer to a portion that corresponds to a main body of the fixed scroll or the orbiting scroll. That is, the head plate of the fixed scroll may be closely attached to a wrap of the orbiting scroll (hereinafter, referred to as an "orbiting wrap"), and the head plate of the orbiting scroll may be closely attached to a wrap of the fixed scroll (hereinafter, referred to as a "fixed wrap").

On the other hand, friction resistance has to be minimized so as to allow the orbiting scroll to smoothly revolve with respect to the fixed scroll. However, the leakage may conflict with the lubrication. That is, when the end of the wrap and the surface of the head plate are strongly attached to each other, it may be advantageous with respect to leakage, however, friction may increase, increasing damage due to noise and abrasion. On the other hand, when adhesion strength is low, the friction may be reduced, however, a sealing force may decrease, increasing the leakage.

Thus, in the related art, a back pressure chamber having an intermediate pressure, which is defined as a value between a discharge pressure and a suction pressure, may be formed in or at a back surface of the orbiting scroll or the fixed scroll to solve the limitations with respect to sealing and friction reduction. That is, the back pressure chamber, which communicates with a compression chamber having an intermediate pressure of a plurality of compression chambers formed between the orbiting scroll and the fixed scroll, may be formed to allow the orbiting scroll and the fixed scroll to be adequately attached to each other, thereby solving the limitations with respect to leakage and lubrication.

The back pressure chamber may be formed on a bottom surface of the orbiting scroll or a top surface of the fixed scroll. For convenience of description, the back pressure chamber formed on the bottom surface of the orbiting scroll and the back pressure chamber formed on the top surface of the fixed scroll may be referred to as a "lower back pressure type scroll compressor" and "an upper back pressure type scroll compressor", respectively. The lower back pressure type scroll compressor has advantages in that the lower back pressure type scroll compressor has a simple structure, and a bypass hole is easily formed. However, as the back pressure chamber is formed on the bottom surface of the orbiting scroll, which performs the orbiting motion, the back pressure chamber may change in configuration and position according to the orbiting motion. As a result, the orbiting scroll may be tilted, causing vibration and noise. In addition, an O-ring provided to prevent the refrigerant from leaking may be quickly worn out. The upper back pressure type scroll compressor has a relatively complicated structure. However, as the back pressure chamber is fixed in configuration and position, the fixed scroll may not be tilted, and sealing of the back pressure chamber may be good.

The fixed scroll may be movably coupled to a main frame. The main frame refer to a part fixed to an inner wall of a casing that defines an outer appearance of the compressor. As the fixed scroll is movably coupled to the main frame, the fixed scroll and the orbiting scroll may be closely attached to each other by a force applied from the back pressure chamber.

FIGS. 1A to 1G are views illustrating a method of assembling a fixed scroll with a main frame according to a related art. FIG. 2 is a cross-sectional view of an assembly of the fixed scroll and the main frame which are assembled using the method according to the related art.

Referring to FIGS. 1A and 1B, an assembly 1 according to the related art includes a plurality of coupling members 6*a*, 6*b*, and 6*c*, a main frame 2, and a fixed scroll 3, which are assembled with each other by a guide pin 7. The plurality of coupling members 6*a*, 6*b*, and 6*c* include a first coupling member 6*a*, a second coupling member 6*b*, and a third coupling member 6*c*. The guide pin 7 may surround a lower portion of each of the coupling members 6*a*, 6*b*, and 6*c*.

When the main frame 2 and the fixed scroll 3 are assembled with each other, a plurality of reference pins 5*a* and 5*b* to guide an assembled position may be used. The plurality of reference pins 5*a* and 5*b* include a first reference pin 5*a* and a second reference pin 5*b*.

In detail, referring to FIG. 1A, the main frame 2 includes a plurality of frame holes 2*a*, into which the plurality of reference pins 5*a* and 5*b* or the plurality of coupling members 6*a*, 6*b*, and 6*c* are inserted. That is, the plurality frame holes 2*a* may include holes, into which the plurality of reference pins 5*a* and 5*b* are inserted, and holes, into which the plurality of coupling members 6*a*, 6*b*, and 6*c* are inserted. The fixed scroll 3 includes a plurality of first holes 4, into which the plurality of reference pins 5*a* and 5*b* are inserted, and a plurality of second holes 5, into which the plurality of coupling members 6*a*, 6*b*, and 6*c* and the guide pin 7 are inserted.

Hereinafter, a method for assembling the frame assembly 1 according to the related art will be described.

Referring to FIG. 1A, the fixed scroll 3 is disposed on the main frame 2 so that the plurality of frame holes 2*a* and the plurality of first and second holes 4 and 5 are aligned with each other. Also, each of the first and second reference pins 5*a* and 5*b* passes through the first hole 4 of the fixed scroll 3 and then is inserted downward.

When the first and second reference pins 5*a* and 5*b* are completely inserted, each of lower portions of the first and second reference pins 5*a* and 5*b* may be inserted into the frame hole 2*a* of the main frame 2. As described above, as the first and second reference pins 5*a* and 5*b* are inserted into the fixed scroll 3 and the main frame 2, the main frame 2 and the fixed scroll 3 may be fixed to or at predetermined positions without moving.

Referring to FIGS. 1B and 1C, in a state in which the first and second reference pins 5*a* and 5*b* are inserted, each of the first and second coupling members 6*a* and 6*b* passes through the second hole 5 of the fixed scroll 3 and then is inserted downward. Each of the first and second coupling members 6*a* and 6*b* is coupled to the frame hole 2*a* of the main frame 2.

A screw thread may be formed on each of the first and second coupling members 6*a* and 6*b*. Thus, each of the first and second coupling members 6*a* and 6*b* may be screw-coupled to the frame hole 2*a* of the main frame 2. Of course, a screw thread may be formed on an inner circumferential surface of the frame hole 2*a*. When the assembly of the first and second coupling members 6*a* and 6*b* is completed, the guide pin 7 may be disposed between the fixed scroll 3 and the main frame 2, in a state in which the guide pin 7 surrounds each of the first and second coupling members 6*a* and 6*b*.

Referring to FIGS. 1D and 1F, in a state in which the assembly of the first and second coupling members 6*a* and 6*b* is completed, the second reference pin 5*b* may be separated. Also, a third coupling member 6*c* may be coupled to a position from which the second reference pin 5*b* is separated, that is, each of the first hole 4 of the fixed scroll 3 and the frame hole 2*a* of the main frame 2. That is, the second reference pin 5*b* may be separated, and then, the third coupling member 6*c* may be coupled to or at the separated position.

The third coupling member 6*c* passes through the second hole 5 of the fixed scroll 3, and then is inserted downward, like the first and second coupling members 6*a* and 6*b*. Also, the third coupling member 6*c* is screw-coupled to the frame hole 2*a* of the main frame 2. Referring to FIG. 1G, in a state in which the main frame 2 and the fixed scroll 3 are assembled with the plurality of coupling members 6*a*, 6*b*, and 6*c*, the first reference pin 5*a* may be separated last.

The frame assembly 1 assembled using the method according to the related art may have the following limitations.

As the plurality of coupling members 6*a*, 6*b*, 6*c* are assembled with the frame assembly 1 several times, the main frame 2 or the fixed scroll 3 may be twisted, or the coupled portion may be deformed whenever the plurality of coupling members 6*a*, 6*b*, 6*c* is assembled. In detail, referring to FIG. 2, the main frame 2 and the fixed scroll 3 may be assembled with each other by the first coupling member 6*a*. When the main frame 2 is assembled with the fixed scroll 3, fixed wrap 3*a* of the fixed scroll 3 may be closely attached to a head plate of orbiting scroll 8, and orbiting wrap 8*a* of the orbiting scroll 8 may be closely attached to the head plate of the fixed scroll 3.

When the main frame 2 and the fixed scroll 3 are assembled with each other by the above-described method, stress may be applied to the fixed scroll 3 in a predetermined direction by a coupling force of the first coupling member 6*a*. That is, the first coupling member 6*a* and the guide pin 7 may be closely attached to each other in a predetermined direction (a left direction in FIG. 2) within the second hole 5 of the fixed scroll 3. Thus, a deformed part or portion 3*b* may be formed in or at an inner circumferential surface of the second hole 5 of the fixed scroll 3 by the stress.

On the other hand, the inner circumferential surface of the second hole 5, which is disposed in a direction opposite to the closely attached direction may be spaced apart from the guide pin 7. That is, a space 7*a* may be defined between the inner circumferential surface of the second hole 5 and an outer circumferential surface of the guide pin 7.

As described above, in the state in which the main frame 2 and the fixed scroll 3 are assembled with each other, if the stress is applied to form the deformed portion 3*b* and the space 7*a* in the fixed scroll 3, the fixed scroll 3 may not easily move with respect to the main frame 2. Thus, the closely attached effect (a refrigerant leakage prevention effect) realized by the fixed scroll and the orbiting scroll due to the operation of the back pressure chamber may be reduced.

Also, when the main frame and the fixed scroll are assembled with each other using the method according to the related art, the plurality of coupling members have to be assembled through several processes. Also, as a complicated process for assembling the coupling member after the reference pin is separated has to be performed, productivity of the frame assembly may be deteriorated.

BRIEF DESCRIPTION OF THE DRAWINGS

Embodiments will be described in detail with reference to the following drawings in which like reference numerals refer to like elements, and wherein.

DETAILED DESCRIPTION

Figure 1A:
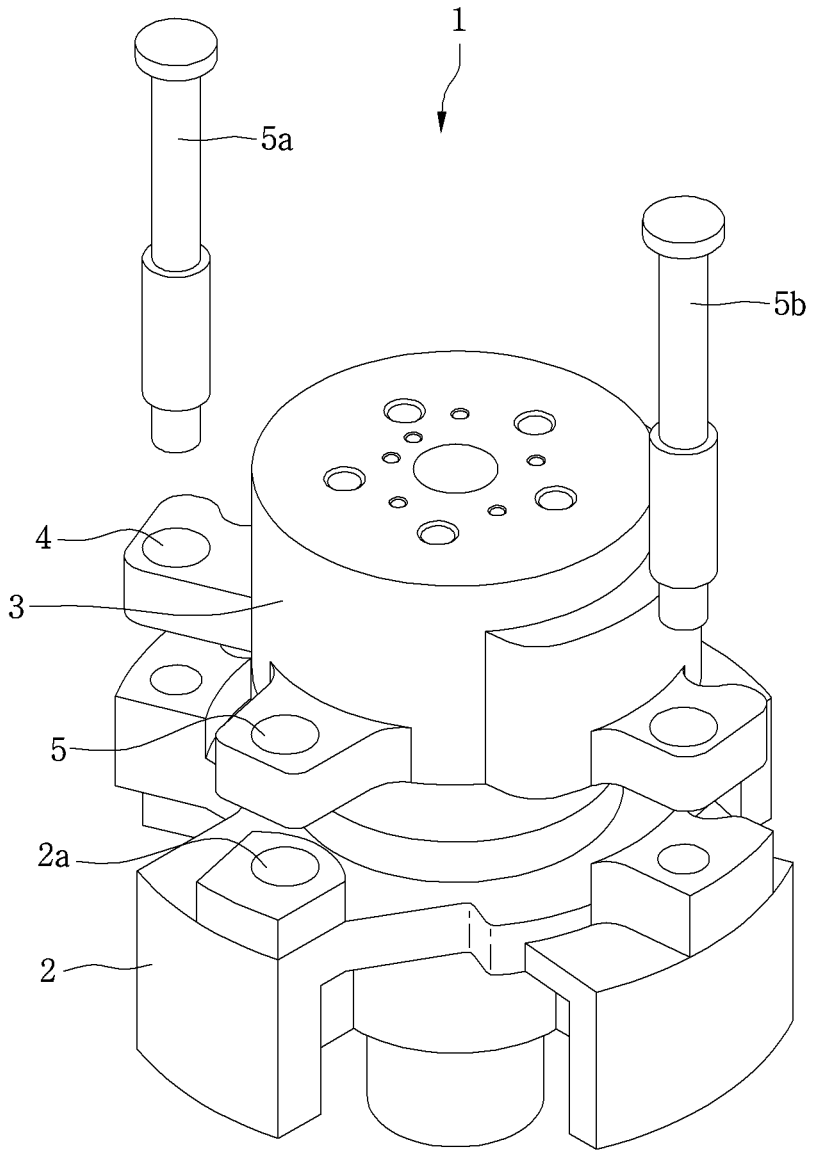
FIGS. 1A to 1G are views illustrating a method for assembling a fixed scroll with a main frame according to a related art.
Figure 1B:
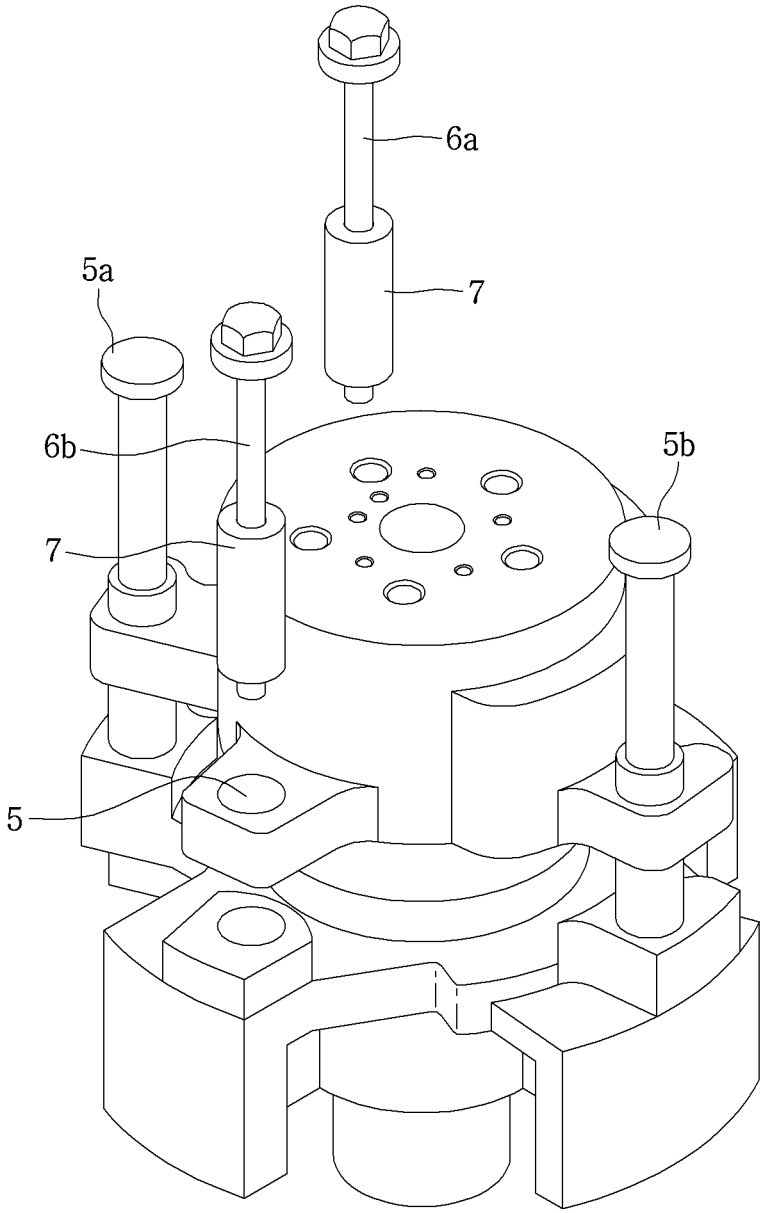
Figure 1C:
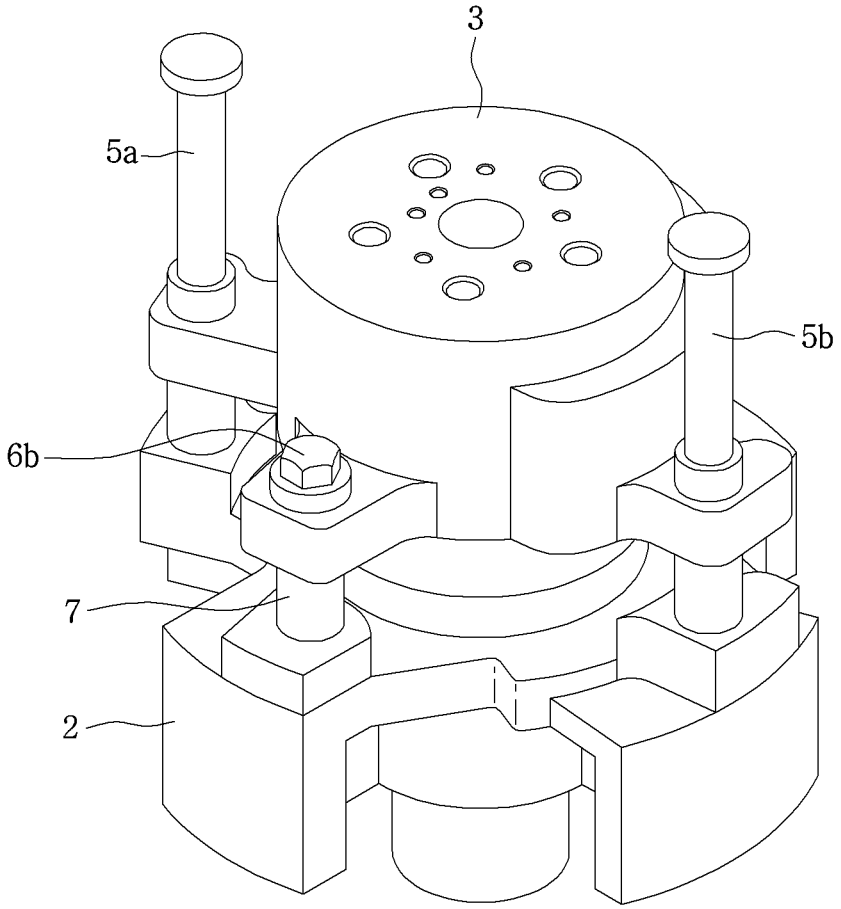
Figure 1D:
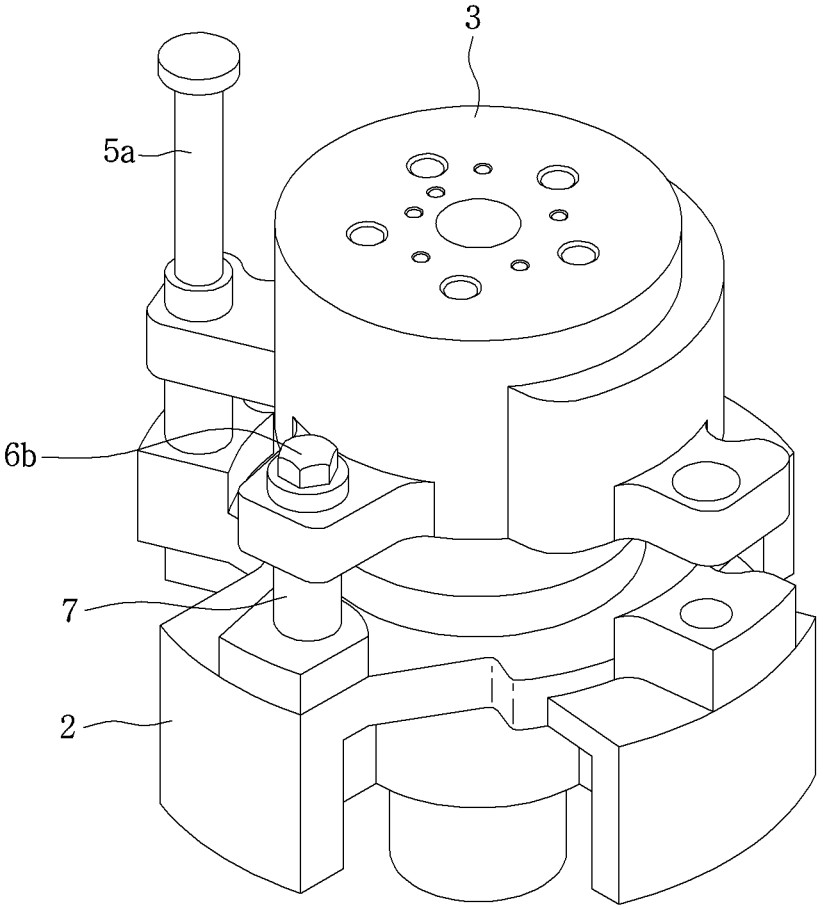
Figure 1E:
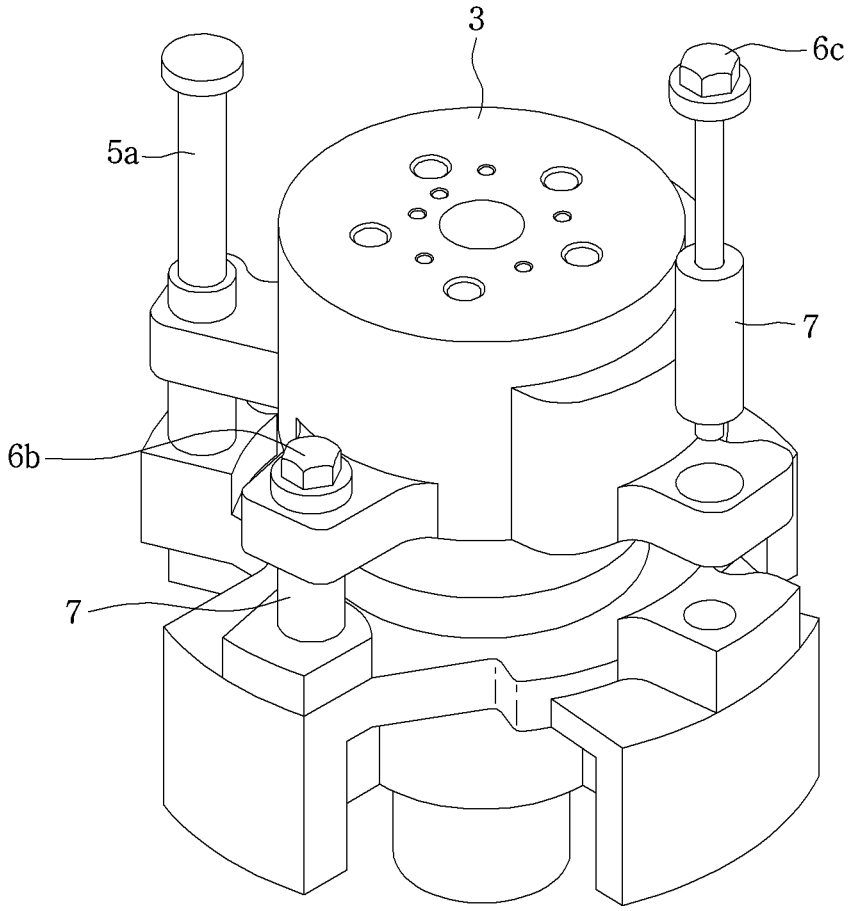
Figure 1F:
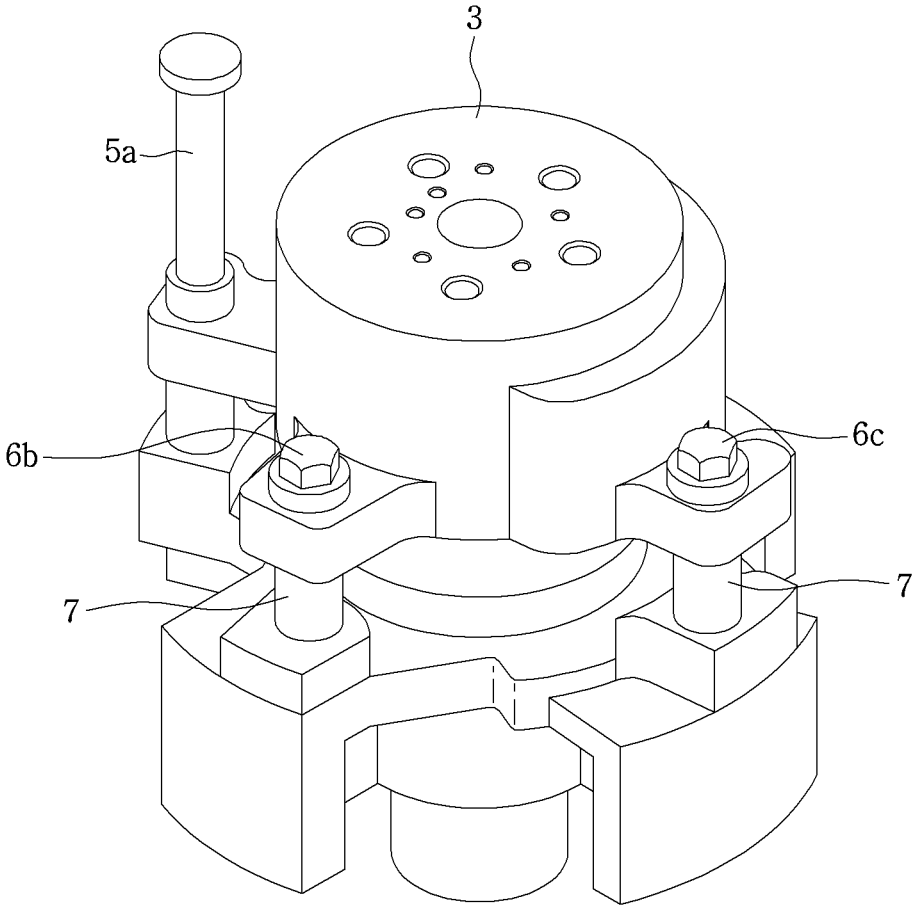
Figure 1G:
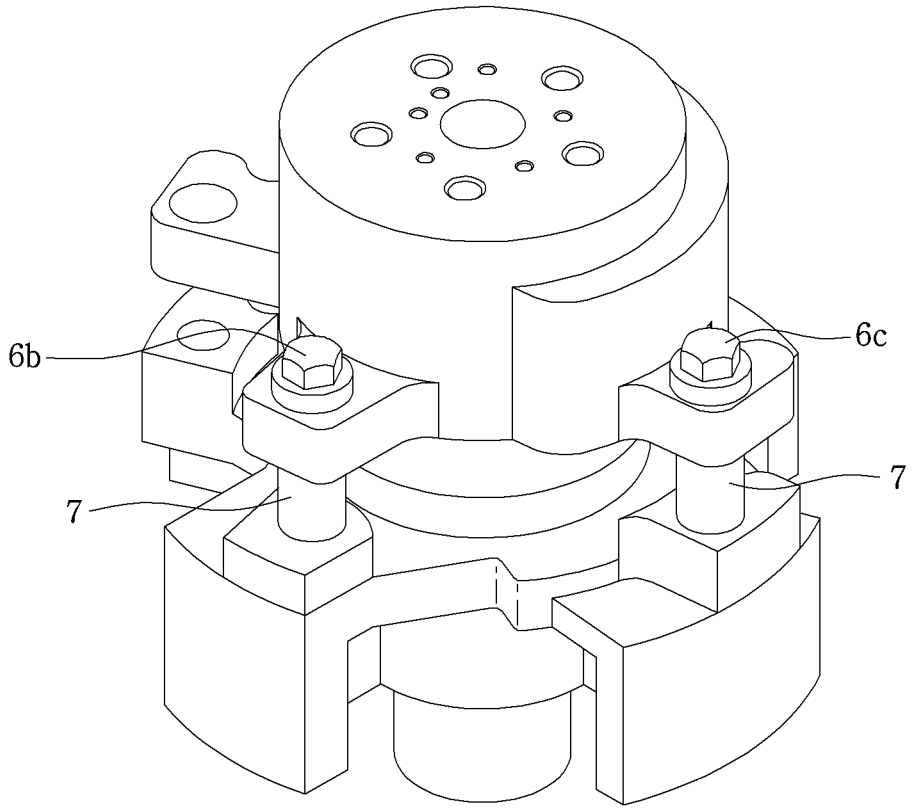
Figure 2:
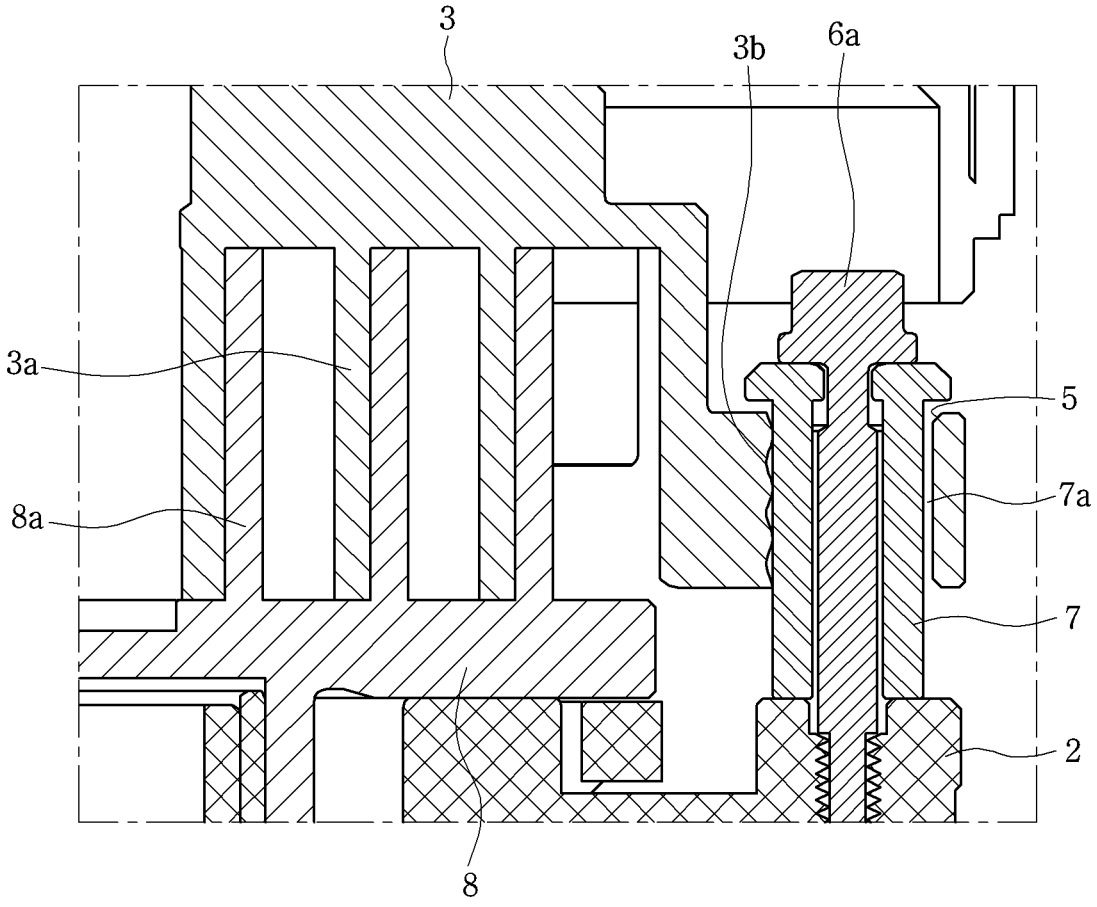
FIG. 2 is cross-sectional view illustrating an assembly of the fixed scroll and the main frame which are assembled with each other using the method according to the related art.
Figure 3:
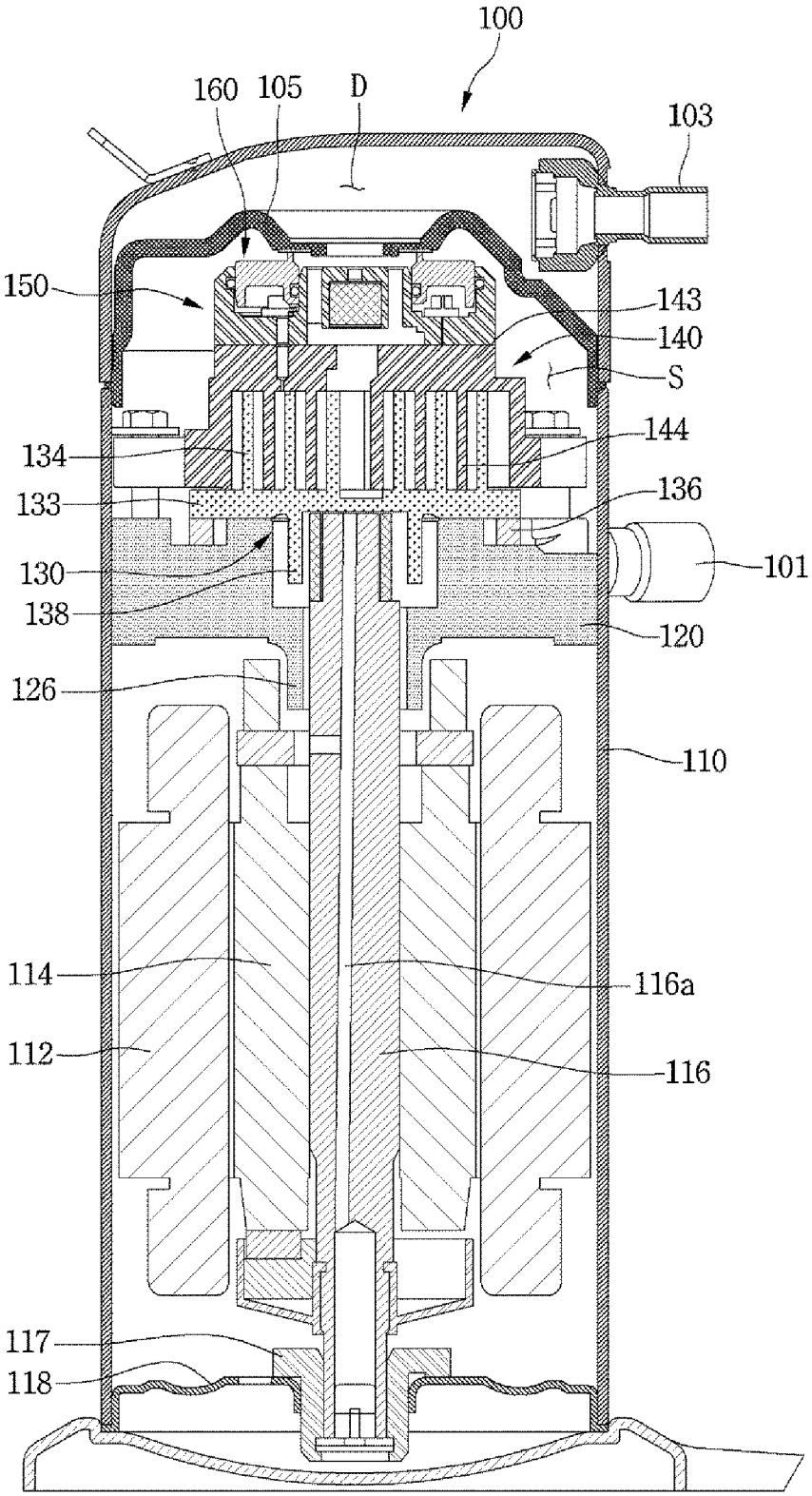
FIG. 3 is a cross-sectional view of a scroll compressor according to an embodiment.
Figure 4:
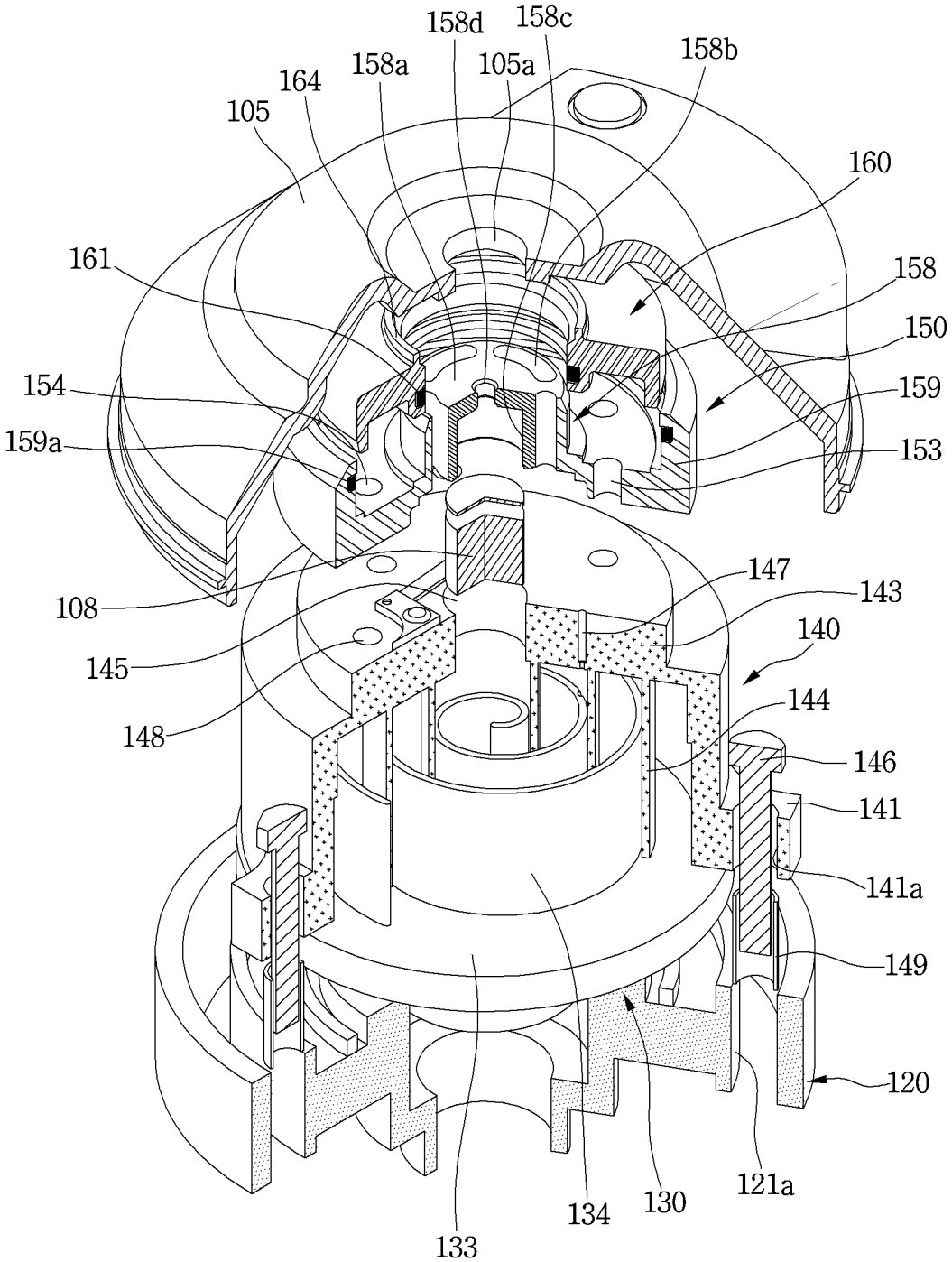
FIG. 4 is an exploded, cut-away, cross-sectional view illustrating a portion of the scroll compressor according to an embodiment.
Figure 5:
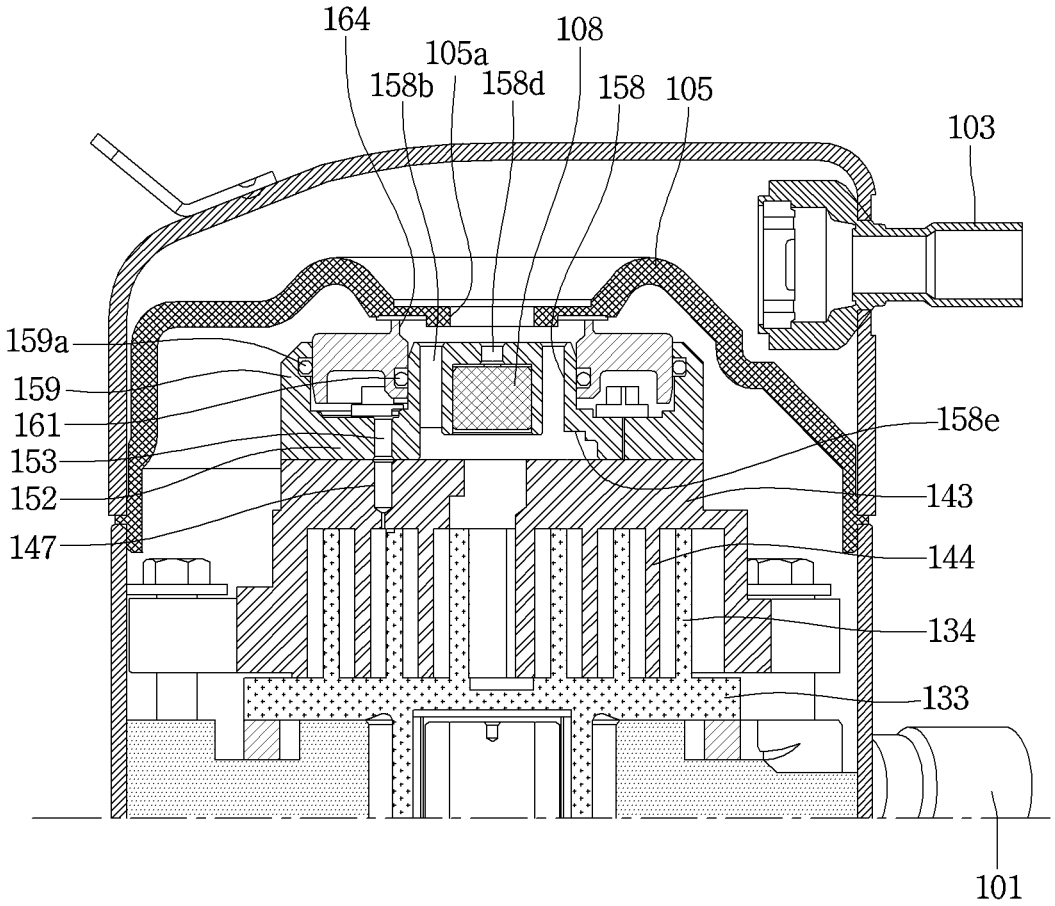
FIG. 5 is a cross-sectional view illustrating a portion of the scroll compressor according to an embodiment.

FIG. 3 is a cross-sectional view of a scroll compressor according to an embodiment. FIG. 4 is an exploded, cut-away, cross-sectional view illustrating a portion of the scroll compressor according to an embodiment. FIG. 5 is a cross-sectional view illustrating a portion of the scroll compressor according to an embodiment.

Referring to FIGS. 3 to 5, a scroll compressor 100 according to an embodiment may include a casing 110 having a suction space S and a discharge space D. A cover 105 may be disposed in an inner upper portion of the casing 110. An inner space of the casing 110 may be partitioned into the suction space S and the discharge space D by the cover 105. An upper side of the cover 105 may correspond to the discharge space D, and a lower side of the cover 105 may correspond to the suction space S. A discharge hole 105*a*, through which a refrigerant compressed at or to a high pressure may be discharged, may be defined in an approximately central portion of the cover 105.

The scroll compressor 100 may further include a suction port 101 that communicates with the suction space S, and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be disposed at a lower portion of the suction space S. The motor may include a stator 112 coupled to an inner wall of the casing 110, a rotor 114 rotatably disposed within the stator 112, and a rotational shaft 116 that passes through a central portion of the stator 114.

A lower portion of the rotational shaft 116 may be rotatably supported by an auxiliary bearing 117 disposed on or at a lower portion of the casing 110. The auxiliary bearing 117 may be coupled to a lower frame 118 to stably support the rotational shaft 116.

The lower frame 118 may be fixed to the inner wall of the casing 110, and a bottom surface of the casing 110 may be used as an oil storage space. Oil stored in the oil storage space may be transferred upward by an oil supply passage 116*a* defined in the rotational shaft 116 and uniformly supplied in the casing 110. The oil supply passage 116*a* may be eccentrically disposed toward one side so that the oil introduced into the oil supply passage 116*a* flows upward by a centrifugal force generated by rotation of the rotational shaft 116.

An upper portion of the rotational shaft 116 may be rotatably supported by a main frame 120. The main frame 120 may be fixed to the inner wall of the casing 110, similar to the lower frame 118. A main bearing 126 that protrudes downward may be disposed on a bottom surface of the main frame 120. The rotational shaft 116 may be inserted into the main bearing 126. An inner wall of the main bearing 126 may function as a bearing surface so that the rotational shaft 116 may smoothly rotate.

An orbiting scroll 130 may be disposed on a top surface of the main frame 120. The orbiting scroll 130 may include an orbiting head plate 133 having an approximately disk shape and disposed on the main frame 120, and an orbiting wrap 134 having a spiral shape and extending from the orbiting head plate 133. The orbiting head plate 133 may define a lower portion of the orbiting scroll 130 and function as a main body of the orbiting scroll 130, and the orbiting wrap 134 may extend upward from the orbiting head plate 133 to define an upper portion of the orbiting scroll 130. The orbiting wrap 134 together with a fixed wrap 144, which will be described herein below, of a fixed scroll 140 may define a compression chamber. The orbiting scroll 130 may be referred to as a "first scroll", and the fixed scroll 140 may be referred to as a "second scroll".

The orbiting head plate 133 of the orbiting scroll 130 may revolve in a state in which the orbiting head plate 133 is supported on the top surface of the main frame 120. An Oldham ring 136 may be disposed between the orbiting head plate 133 and the main frame 120 to prevent the orbiting scroll 130 from revolving. A boss 138, into which an upper portion of the rotational shaft 116 may be inserted, may be disposed on a bottom surface of the orbiting head plate 133 of the orbiting scroll 130 to easily transmit a rotational force of the rotational shaft 116 to the orbiting scroll 130. The fixed scroll 140 engaged with the orbiting scroll 130 may be disposed on the orbiting scroll 130.

The fixed scroll 140 may include a plurality of guides 141 that protrude from an outer circumferential surface of the fixed scroll 140 and each of which may have a guide hole 141*a*, a guide pin 149 inserted into the guide hole 141*a* and disposed on the top surface of the main frame 120, and a coupling member 146 inserted into the guide pin 149 and coupled to a frame guide hole 121*a* of the main frame 120. The fixed scroll 140 may further include a fixed head plate 143 having a disk shape, and the fixed wrap 144 that extends from the fixed head plate 143 toward the orbiting head plate 133 and which is engaged with the orbiting wrap 134 of the orbiting scroll 130. The fixed head plate 143 may define an upper portion of the fixed scroll 140 and function a main body of the fixed scroll 140, and the fixed wrap 144 may extend downward from the fixed head plate 143 to define a lower portion of the fixed scroll 140. For convenience of description, the orbiting head plate 133 may be referred to as a "first head plate", and the fixed head plate 143 may be referred to as a "second head plate". Further, the orbiting wrap 134 may be referred to as a "first wrap", and the fixed wrap 144 may be referred to as a "second wrap".

An end of the fixed wrap 144 may be disposed to contact the orbiting head plate 133, and an end of the orbiting wrap 134 may be disposed to contact the fixed head plate 143. The fixed wrap 144 may extend in a predetermined spiral shape, and a discharge hole 145, through which the compressed refrigerant may be discharged, may defined in an approximately central portion of the fixed head plate 143. A suction hole (see reference numeral 196 of FIG. 8), through which the refrigerant within the suction space S maybe suctioned, may be defined in a side surface of the fixed scroll 140. The refrigerant suctioned through the suction hole 196 may be introduced into the compression chamber defined by the orbiting wrap 134 and the fixed wrap 144.

In detail, the fixed wrap 144 and the orbiting wrap 134 may define a plurality of compression chambers. Each of the compression chambers may be reduced in volume while revolving and moving to the discharge hole-side to compress the refrigerant. Thus, the compression chamber adjacent to the suction hole 196 may be minimized in pressure, and the compression chamber that communicates with the discharge hole 145 may be maximized in pressure. Also, the compression chamber between the above-described compression chambers may have an intermediate pressure that corresponds between a suction pressure of the suction hole 196 and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 to transfer the refrigerant of the compression chamber having the intermediate pressure to the back pressure chamber BP may be defined in the fixed head plate 143 of the fixed scroll 140. That is, the intermediate pressure discharge hole 147 may be defined in a portion of the fixed scroll 130 at which the pressure in the compression chamber that communicates with the intermediate pressure discharge hole 147 is greater than the pressure in the suction space S and less than the pressure in the discharge space D. The intermediate pressure discharge hole 147 may pass from a top surface to a bottom surface of the fixed head plate 143.

A back pressure chamber assembly 150 and 160 to define the back pressure chamber may be disposed on the fixed scroll 140. The back pressure chamber assembly 150 and 160 may include a back pressure part or portion 150, and a floating plate 160 separably coupled to the back pressure portion 150 and fixed to the upper portion of the fixed head plate 143 of the fixed scroll 140.

The back pressure portion 150 may have an approximately annular shape with a hollow and include a support 152 that contacts the fixed head plate 143 of the fixed scroll 140. An intermediate pressure suction hole 153 that communicates with the intermediate pressure discharge hole 147 may be defined in the support 152. The intermediate pressure suction hole 153 may pass from a top surface to a bottom surface of the support 152.

A second coupling hole 154 that communicates with a first coupling hole 148 defined in the fixed head plate 143 of the fixed scroll 140 may be defined in the support 152. The first coupling hole 148 and the second coupling hole 154 may be coupled to each other by a plate coupling member (see reference numeral 170 of FIG. 6).

The back pressure portion 150 may include a plurality of walls 159 and 159 that extend upward from the support 152 and each of which has an approximately cylindrical shape. The plurality of walls 158 and 159 may include a first wall 158 that extends upward from an inner circumferential surface of the support 152, and a second wall 159 that extends upward from an outer circumferential surface of the support 152. Each of the first and second walls 158 and 159 may have an approximately cylindrical shape.

The first and second walls 158 and 159 together with the support 152 may define a space having a predetermined shape. The space may define the above-described back pressure chamber BP.

The first wall 158 may include a top surface 158*a* defining a top surface of the first wall 158. The first wall 158 may include at least one intermediate discharge hole 158*b* that communicates with the discharge hole 145 of the fixed head plate 143 to discharge the refrigerant discharged from the discharge hole 145 toward the cover 105. The at least one intermediate discharge hole 158*b* may include a plurality of intermediate discharge holes 158*b* that passes from a bottom surface of the first wall 158 to the top surface 158*a*.

An inner space of the first wall 158 having a cylindrical shape may communicate with the discharge hole 145 to define a portion of a discharge passage to transfer the discharged refrigerant to the discharge space D. A discharge valve 108 having an approximately circular pillar shape may be disposed inside the first wall 158. The discharge valve 108 may be disposed on or in the discharge hole 145 and may have a size sufficient to completely cover the discharge hole 145. Thus, when the discharge valve 108 contacts the fixed head plate 143 of the fixed scroll 140, the discharge valve 108 may close the discharge hole 145.

The discharge valve 108 may be movable upward or downward according to a variation in pressure applied to the discharge valve 108. Also, the inner circumferential surface of the first wall 158 may define a moving guide 158*c* to guide movement of the discharge valve 108.

A discharge pressure apply hole 158*d* may be defined in the top surface 158*a* of the first wall 158. The discharge pressure apply hole 158*d* may communicate with the discharge hole 145. The discharge pressure apply hole 158*d* may be defined in an approximately central portion of the top surface 158*a*, and the plurality of intermediate discharge holes 158*b* may be disposed to surround the discharge pressure apply hole 158*d*.

For example, when operation of the scroll compressor 100 stops, if the refrigerant flows backward from the discharge space D toward the discharge hole 145, the pressure applied to the discharge pressure apply hole 158*d* may be greater than the discharge hole-side pressure. That is, the pressure may be applied downward to a top surface of the discharge valve 108, and thus, the discharge valve 108 may move downward to close the discharge hole 145.

On the other hand, when the scroll compressor 100 operates to compress the refrigerant in the compression chamber, a discharge hole-side pressure may be greater than the pressure within the discharge space D. Thus, an upward pressure may be applied to a bottom surface of the discharge valve 108, and thus, the discharge valve 108 may move upward to open the discharge hole 145. When the discharge hole 145 is opened, the refrigerant discharged from the discharge hole 145 may flow toward the cover 105 via the intermediate discharge hole 158*b*, and then, may be discharged outside of the compressor 100 through the discharge port 103 via the discharge hole 105*a*.

The back pressure portion 150 may include a stepped portion 158*e* disposed inside a portion at which the first wall 158 and the support 152 are connected to each other. The refrigerant discharged from the discharge hole 145 may reach a space defined by the stepped portion 158*e*, and then, may flow to the intermediate discharge hole 158*b*.

The second wall 159 may be spaced a predetermined distance outward from the first wall 158 to surround the first wall 158.

The back pressure portion 150 may include a space having an approximately U-shaped cross-section formed by the first wall 158, the second wall 159, and the support 152. The floating plate 160 may be disposed in the space. A portion of the space covered by the floating plate 160 may define the back pressure chamber BP. On the other hand, a space defined by the first and second walls 158 and 159 of the back pressure portion 150, the support 152, and the floating plate 160 may define the back pressure chamber BP.

The floating plate 160 may have an annular plate shape and include an inner circumferential surface that faces an outer circumferential surface of the first wall 158 and an outer circumferential surface that faces an inner circumferential surface of the second wall 159. That is, the inner circumferential surface of the floating plate 160 may be disposed to contact the outer circumferential surface of the first wall 158, and the outer circumferential surface of the floating plate 160 may be disposed to contact the inner circumferential surface of the second wall 159.

O-rings 159*a* and 161 may be disposed on or at contact portions between the floating plate 160 and the first and second walls 158 and 159, respectively. In detail, the O-rings 159*a* and 161 may include a first O-ring 159*a* disposed on or at the contact portion between the inner circumferential surface of the second wall 159 and the outer circumferential surface of the floating plate 160, and a second O-ring 161 disposed on or at the contact portion between the outer circumferential surface of the first wall 158 and the inner circumferential surface of the floating plate 160. For example, the first O-ring 159*a* may be disposed on the inner circumferential surface of the second wall 159, and the second O-ring 161 may be disposed on the inner circumferential surface of the floating plate 160. Refrigerant leakage through contact surfaces between the first and second walls 158 and 159 and the floating plate 160, that is, refrigerant leakage from the back pressure chamber BP may be prevented by the 0-rings 159*a* and 161.

A rib 164 that extends upward may be disposed on a top surface of the floating plate 160. For example, the rib 164 may extend upward from the inner circumferential surface of the floating plate 160.

The rib 164 may be movably disposed to selectively contact a bottom surface of the cover 105. When the rib 164 contacts the cover 105, the suction space S and the discharge space D may be partitioned. On the other hand, when the rib 164 is spaced from the bottom surface of the cover 105, that is, when the rib 164 moves in a direction away from the cover 105, the suction space S and the discharge space D may communicate with each other.

In detail, while the scroll compressor 100 operates, the floating plate 160 may move upward to allow the rib 164 to contact the bottom surface of the cover 105. Thus, the rib 164 may serve as a sealing member so that the refrigerant discharged from the discharge hole 145 to pass through the intermediate discharge hole 158*b* does not leak into the suction space S, but rather, is discharged into the discharge space D.

On the other hand, when the scroll compressor 100 stops, the floating plate 160 may move downward to allow the rib 164 to be spaced apart from the bottom surface of the cover 105. Thus, the discharged refrigerant disposed at the discharge cover-side may flow toward the suction space S through the space between the rib 164 and the cover 105.

Figure 6:
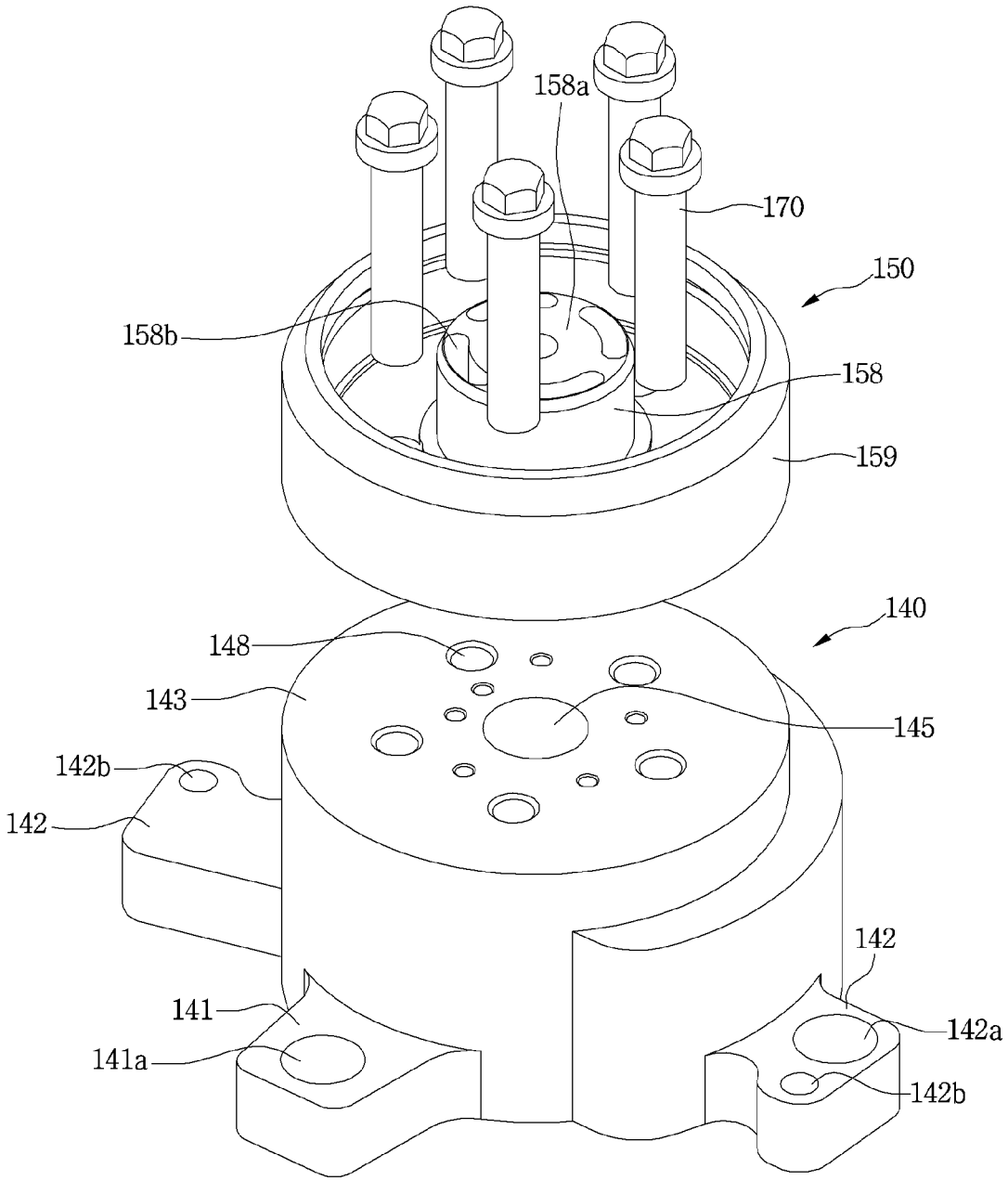
FIG. 6 is an exploded perspective view illustrating a coupled structure of the fixed scroll and a back pressure portion according to an embodiment.
Figure 7:
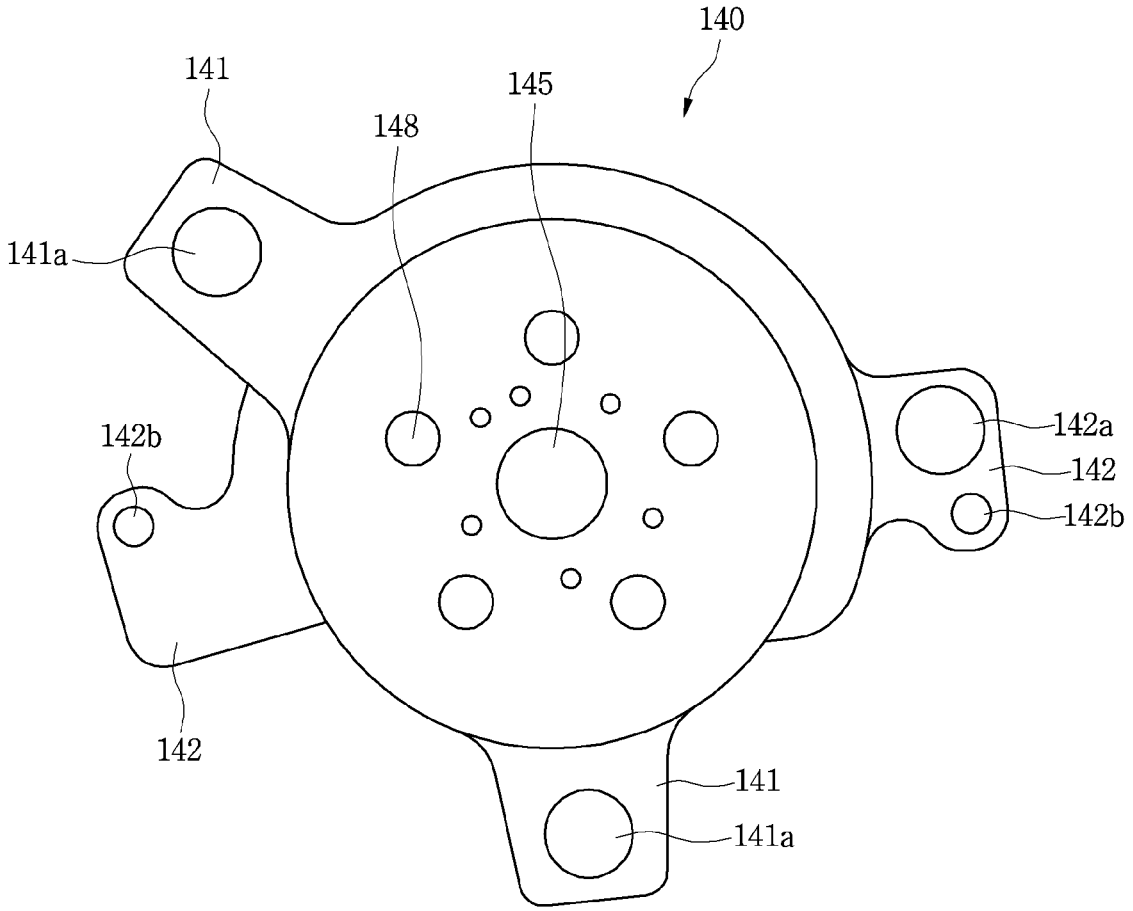
FIG. 7 is a plan view of the fixed scroll according to an embodiment.

FIG. 6 is an exploded perspective view illustrating a coupled structure of the fixed scroll and the back pressure portion according to an embodiment. FIG. 7 is a plan view of the fixed scroll according to an embodiment.

Referring to FIGS. 6 and 7, the fixed scroll 140 according to an embodiment may be coupled to a lower portion of a back pressure portion 150 by the plate coupling member 170. In detail, the fixed scroll 140 may include at least one first coupling hole 148 defined in the fixed head plate 143 and into which the plate coupling member 170 may be inserted. The plate coupling member 170 may pass through the second coupling hole 154 of the back pressure portion 150 to extend downward, and then, may be coupled to the first coupling hole 148.

The at least one first coupling hole 148 may include a plurality of the first coupling holes 148. The plurality of first coupling holes 148 may be disposed to surround the discharge hole 145 defined in the approximately central portion of the fixed head plate 143.

The fixed scroll 140 may include a plurality of coupling guides 141 and 142 to guiding coupling of the fixed scroll 140 and the main frame 120. The plurality of coupling guides 141 and 142 may be disposed to protrude outward from an outer circumferential surface of the fixed head plate 143. Also, the plurality of coupling guides 141 and 142 may be disposed to be spaced apart from each other.

The plurality of coupling guides 141 and 142 may include a first coupling guide 141, to which the coupling member 146 may be coupled, and a second coupling guide 142 having a reference pin coupling hole 142*b*, to which each of reference pins 200*a* and 200*b* may be coupled.

A plurality of the first coupling guide 141 may be provided, and the plurality of first coupling guides 141 may be disposed to face each other. Also, a plurality of the second coupling guide 142 may be provided, and the plurality of second coupling guides 142 may be disposed to face each other.

For example, the first coupling guide 141 may be disposed between two second coupling guides 142, and the second coupling guide 142 may be disposed between two first coupling guides 141. Although two first coupling guides 141 and two second coupling guides 142 are provided in the drawings, the number of first and second coupling guides 141 and 142 may not be limited thereto.

In detail, a first guide hole 141*a*, into which the coupling member 146 and a guide pin 149 may be inserted, may be defined in the first coupling guide 141. The guide pin 149 may be disposed to surround a lower portion of the coupling member 146.

A second guide hole 142*a*, into which the coupling member 146 and the guide pin 149 may be inserted, and a reference pin coupling hole 142*b*, to which the first reference pin 200*a* may be coupled, may be defined in one of the plurality of second coupling guides 142. Also, a reference pin coupling hole 142*b*, to which the second reference pin 200*b* may be coupled, may be defined in the other one of the plurality of second coupling guides 142. For convenience of description, the coupling member 146 coupled to the first guide hole 141*a* may be referred to as a "first coupling member", and the coupling member 146 coupled to the second guide hole 142*a* may be referred to as a "second coupling member".

As described above, although the plurality of second coupling guides 142 having forms different from each other are illustrated in the drawings, embodiments are not limited thereto. For example, the plurality of second coupling guides 142 may have a same form. That is, the second guide hole 142*a* and the reference pin coupling hole 142*b* may be defined in each of the plurality of second coupling guides 142.

Hereinafter, a method for assembling the fixed scroll 140 with the main frame 120 according to an embodiment will be described.

Figure 8:
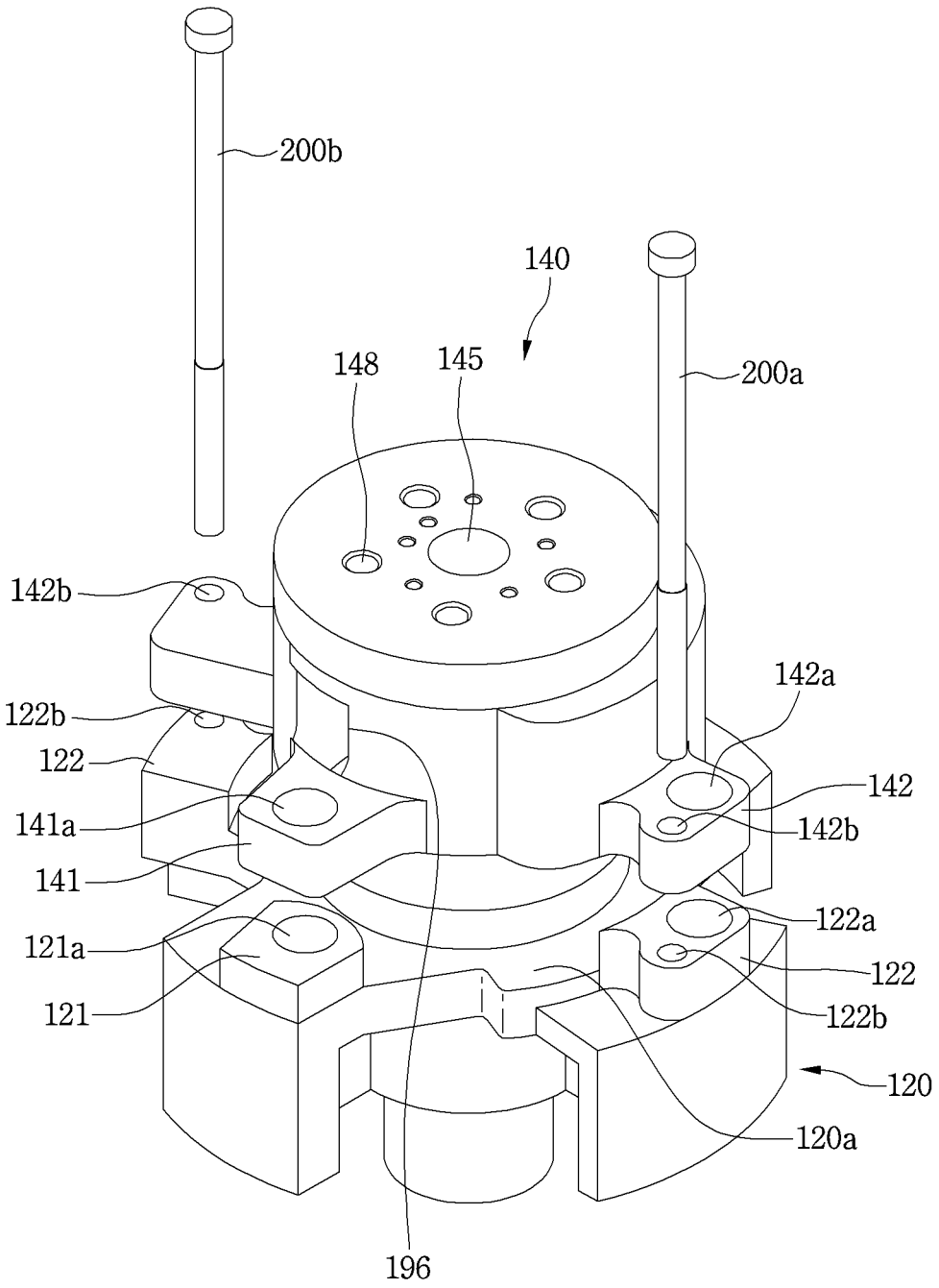
FIGS. 8 to 11 are views illustrating a method for assembling the fixed scroll with a main frame according to an embodiment.

FIGS. 8 to 11 are views illustrating a method for assembling a fixed scroll with a main frame according to an embodiment. Referring to FIG. 8, the main frame 120 according to an embodiment may include a plurality of frame guides 121 and 122 that protrude outward from an outer circumferential surface of a main body 120*a* of the main frame 120.

The plurality of frame guides 121 and 122 may be disposed to correspond to the first and second coupling guides 141 and 142 of the fixed scroll 140, respectively. In detail, the plurality of frame guides 121 and 122 may include a plurality of first frame guides 121 disposed to correspond to the plurality of first coupling guides 141, and a plurality of second frame guides 122 disposed to correspond to the plurality of second coupling guides 142.

A first frame guide hole 121*a*, to which the coupling member (see the first coupling member 146) may be coupled, may be defined in each of the plurality of first frame guides 121. The coupling member 146 may pass through the first guide hole 141*a* of the fixed scroll 140, and then, may be screw-coupled to the first frame guide hole 121*a*.

The guide pin 149 may pass through the first guide hole 141*a*, and then, may be disposed on an upper portion of the first frame guide 121. That is, the guide pin 149 may have a diameter greater than an inner diameter of the first frame guide hole 121*a*. Thus, the guide pin 149 may be disposed above the first frame guide hole 121*a*.

A second frame guide hole 122*a*, into which the coupling member (see the second coupling member 146) may be inserted, and a reference pin coupling hole 122*b*, to which the first reference pin 200*a* may be coupled, may be defined in one of the plurality of second frame guides 122. A reference pin coupling hole 122*b*, to which a second reference pin 200*b* may be coupled, may be defined in the other one of the plurality of second frame guides 122.

As described above, although the plurality of second frame guides 122 having forms different from each other are illustrated in the drawings, embodiments not limited thereto. For example, the plurality of second frame guides 122 may have a same form. That is, each of the second frame guides 122 may include the second frame guide hole 122*a* and the reference pin coupling hole 122*b*. The guide hole 142*a* and the reference pin coupling hole 142*b* may be defined in each of the plurality of second coupling guides 142. For convenience of description, the reference pin coupling hole 142*b* may be referred to as a "first reference pin coupling hole", and the reference pin coupling hole 122*b* may be referred to as a "second reference coupling hole"

Hereinafter, an assembling method according to this embodiment will be described.

Referring to FIG. 8, the fixed scroll 140 may be disposed above the main frame 120. The fixed scroll 140 may be disposed above the main frame 120 so that the plurality of first and second coupling guides 141 and 142 may correspond to the first and second frame guides 121 and 122.

Each of the first and second reference pins 200*a* and 200*b* may pass through the first reference pin coupling hole 142*b* of the fixed scroll 140, and then may be inserted into the second reference pin coupling hole 122*b* of the main frame 120. Of course, each of the first and second reference pin coupling holes 122*b* and 142*b* may have a diameter greater than a diameter of each of the first and second reference pins 200*a* and 200*b*. As the first and second reference pins 200*a* and 200*b* may be, respectively, inserted into the first and second reference pin coupling holes 122*b* and 142*b*, the main frame 120 and the fixed scroll 140 may be maintained in an aligned state at a predetermined position (a centering position) without moving.

Figure 9:
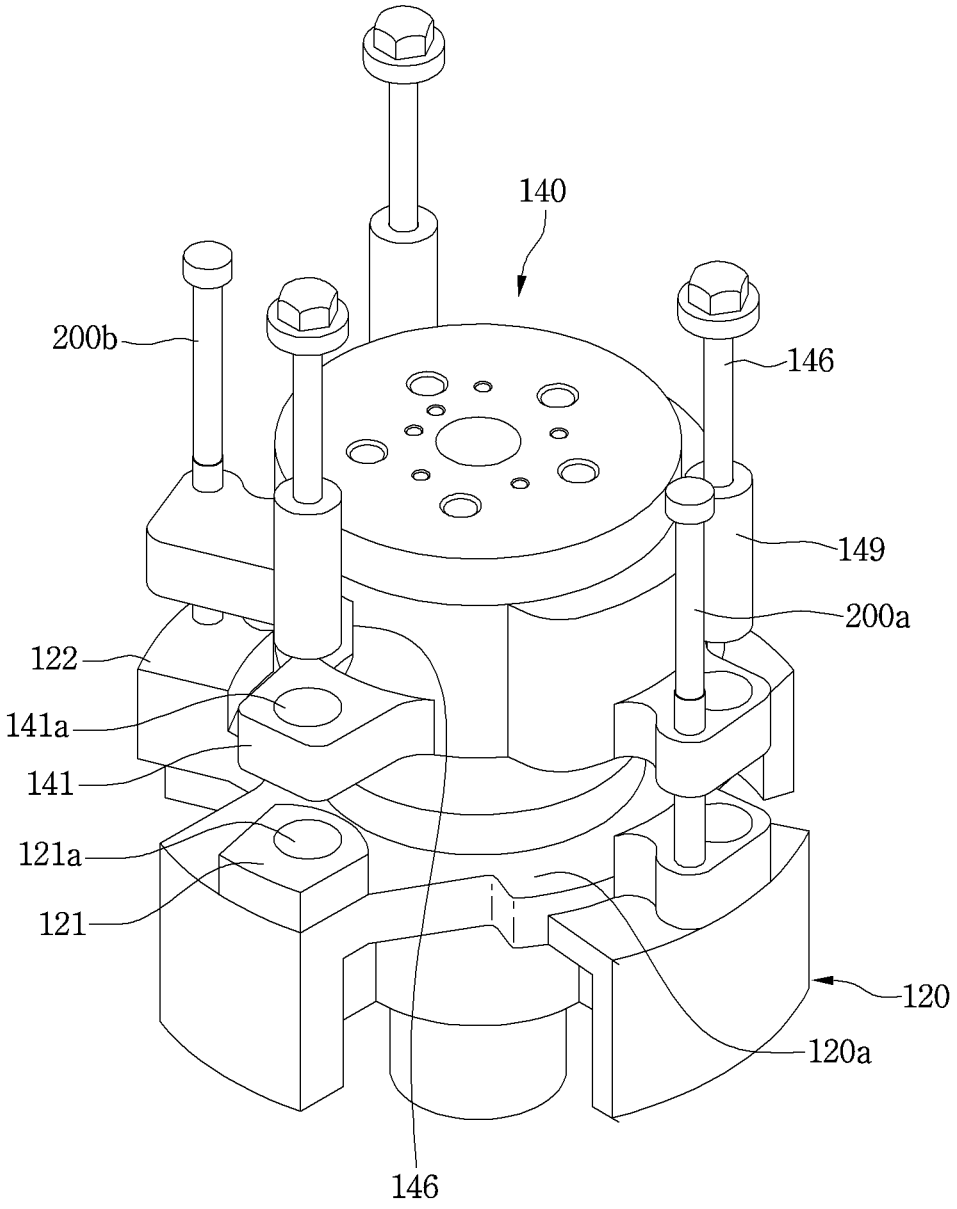
Figure 10:
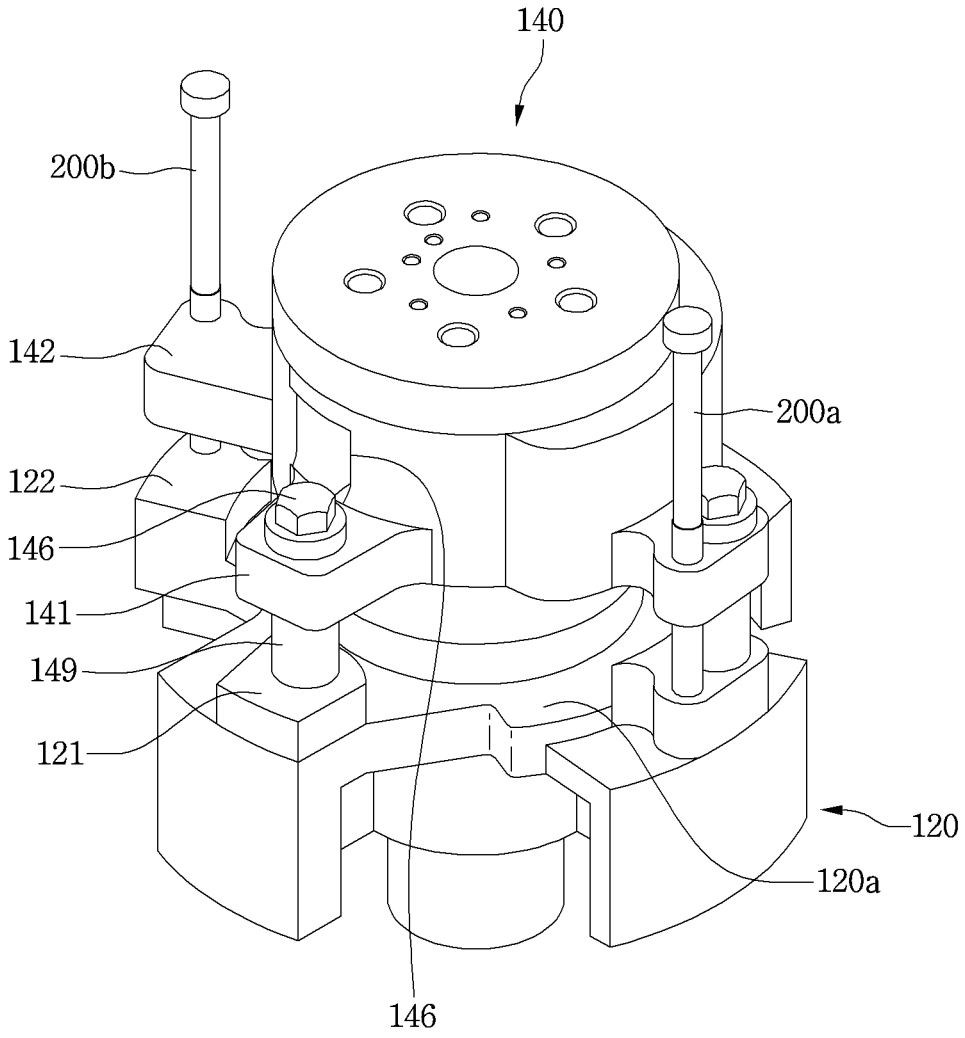

Next, referring to FIGS. 9 and 10, the plurality of coupling members 146 may be, respectively, inserted into the first and second guide holes 141*a* and 142*a* in astute in which each of the coupling members 146 is inserted into the guide pin 149. The guide pin 149 together with the coupling member 146 may be inserted into the first and second guide holes 141*a* and 142*a*.

The plurality of coupling members 146 may be inserted into the first and second frame guide holes 121*a* and 122*a*, and then, may be coupled to the main frame 120. Also, the guide pin 149 may be seated on an upper portion of each of the first and second frame guides 121 and 122.

For example, as illustrated in FIGS. 9 and 10, three coupling members 146 may be inserted at a time into the first guide hole 141*a* of the first coupling guide 141 and the second guide hole 142*a* of the second coupling guide 142. Also, the coupling member 146 passing through the first guide hole 141*a* may be screw-coupled to the first frame guide hole 121*a* of the first frame guide 121, and the coupling member 146 passing through the second guide hole 142*a* may be screw-coupled to the second frame guide hole 122*a* of the second frame guide 122.

Figure 11:
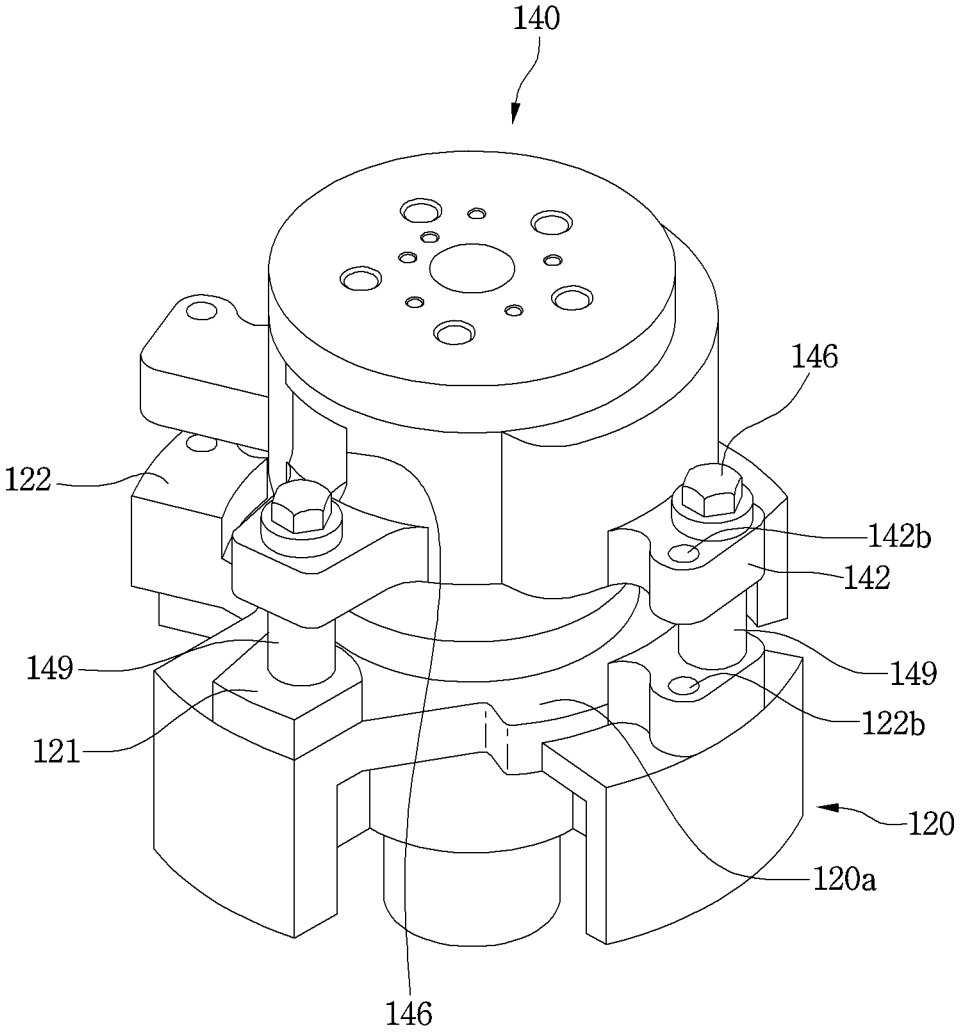

As described above, when the first and second reference pins 200*a* and 200*b* inserted into the first and second reference pin coupling holes 122*b* and 142*b* are separated after the plurality of coupling members 146 are coupled, assembly of the main frame 120 and the fixed scroll 140 may be completed, as illustrated in FIG. 11.

According to the above-described assembling process, in a state in which the first and second reference pins 200*a* and 200*b* are inserted into the main frame 120 and the fixed scroll 140 to guide the coupling position, the plurality of coupling members 146 may be coupled to the main frame 120 and the fixed scroll 140 through one process. Thus, the assembling process may be simplified. Also, when compared to when the plurality of coupling members are assembled through several processes, deformation or twisting of the coupled portion due to the coupling force of the coupling members may be prevented.

Figure 12:
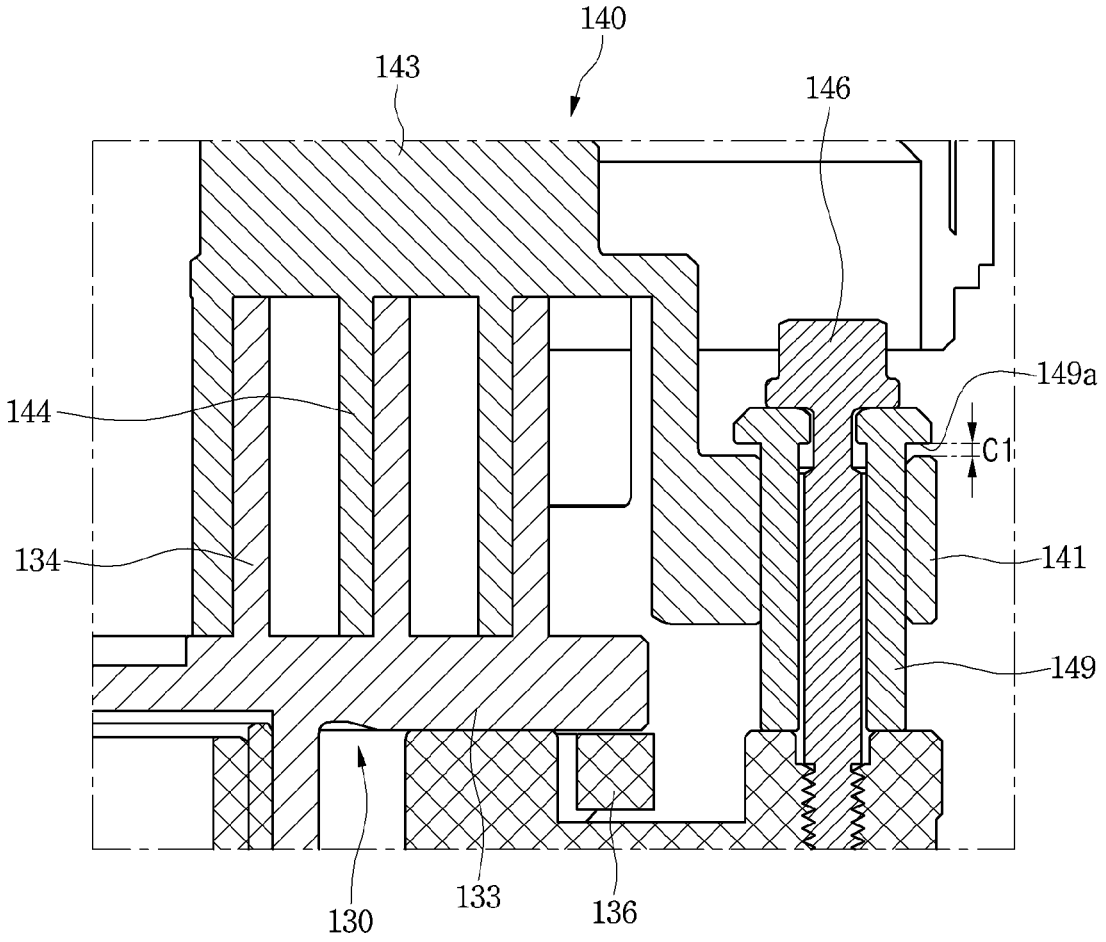
FIGS. 12 and 13 are cross-sectional views illustrating a coupled state of the fixed scroll and the main frame according to an embodiment.
Figure 13:
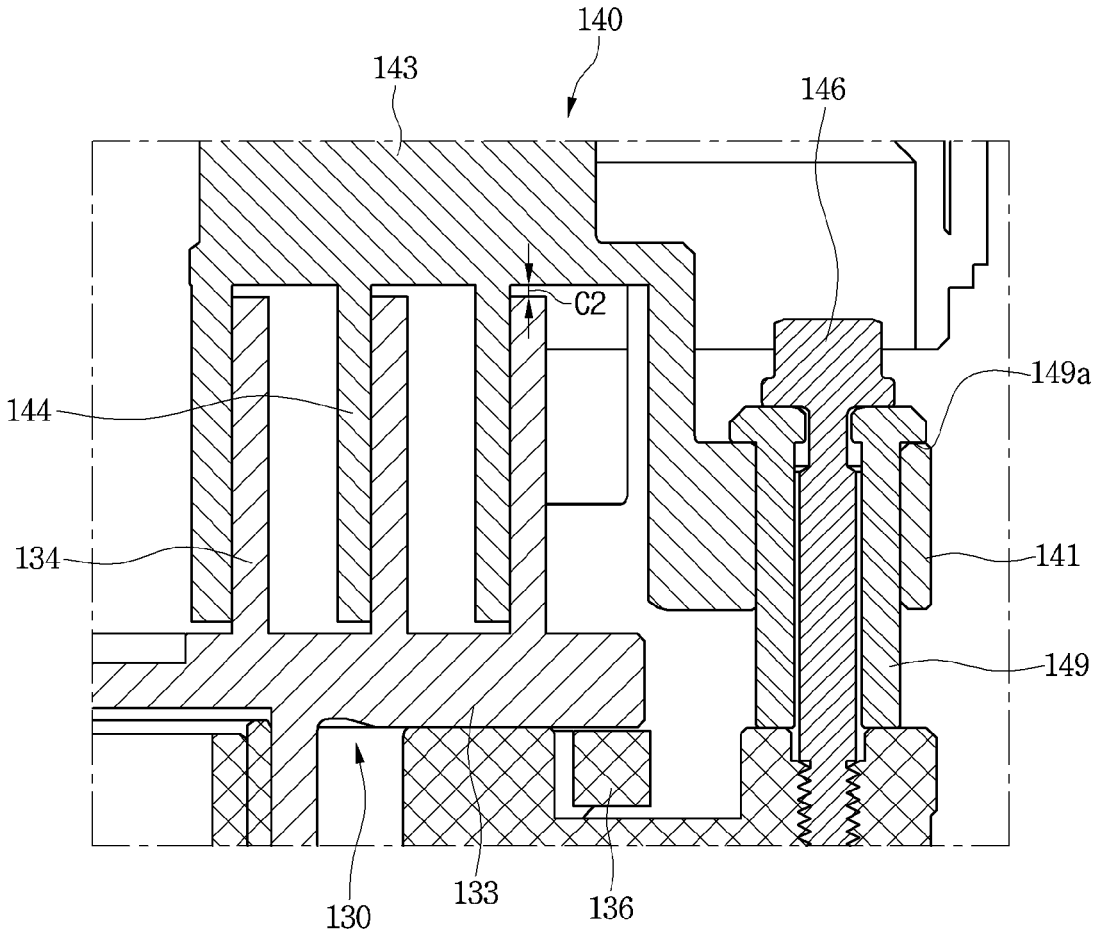

FIGS. 12 and 13 are cross-sectional views illustrating a coupled state of the fixed scroll and the main frame according to an embodiment. FIG. 12 illustrates a state in which the fixed scroll moves downward and then is closely attached to the orbiting head plate of the orbiting scroll. FIG. 13 illustrates a state in which the fixed scroll moves upward and then is spaced apart from the orbiting scroll.

Referring to FIGS. 12 and 13, in a state in which the coupling member 146 according to an embodiment is coupled to the main frame 120 and the fixed scroll 140, the orbiting wrap 134 of the orbiting scroll 130 may extend from the orbiting head plate 133 to the fixed head plate 143 of the fixed scroll 140, and the fixed wrap 144 of the fixed scroll 140 may extend from the fixed head plate 143 to the orbiting plate 133. Also, the guide pin 149 may be supported by an upper portion of the main frame 120 in a state in which the guide pin 149 passes through the fixed scroll 140. The coupling member 146 may be inserted into the guide pin 149 and then screw-coupled to the main frame 120.

The fixed scroll 140 may vertically move while the scroll compressor 100 operates or is stopped. For example, when the scroll compressor 100 initially operates in a state in which the scroll compressor 100 is stopped, the fixed scroll 140 may be lifted upward by the suction pressure of the refrigerant. An end of the orbiting wrap 134 of the orbiting scroll 130 may be spaced a distance C2 from the fixed head plate 143 of the fixed scroll 140. Also, an upper end of the first coupling guide 141 of the fixed scroll 140 may be disposed to contact a stepped portion 149*a* formed on an upper portion of the guide pin 149 (see FIG. 13).

The back pressure chamber BP may be defined above the fixed scroll 140. When the refrigerant is compressed while the scroll compressor 100 operates, the refrigerant having the intermediate pressure may be introduced into the back pressure chamber BP. In this case, the fixed scroll 140 may move downward by the pressure of the back pressure chamber BP, and thus, the fixed scroll 140 may be closely attached to the orbiting scroll 130.

Also, as the fixed scroll 140 moves, the stepped portion 149*a* of the guide pin 149 may be spaced a distance C1 from an upper end of the first coupling guide 141 of the fixed scroll 140. That is, the fixed wrap 144 of the fixed scroll 140 may be closely attached to the orbiting head plate 133 of the orbiting scroll 130, and the orbiting wrap 134 of the orbiting scroll 130 may be closely attached to the fixed head plate 143 of the fixed scroll 140.

Due to the above-described close attachment, a sealing effect of the compression chamber defined by the fixed scroll 140 and the orbiting scroll 130 may be realized. Also, as described above, as the fixed scroll 140 is vertically movable with respect to the main frame 120, refrigerant leakage of the compression chamber may be prevented.

According to embodiments disclosed herein, as the fixed scroll includes the plurality of holes for respectively coupling the coupling member and the reference pin to the coupling portions that protrude outward from the fixed head plate, and the plurality of coupling portion may be coupled at once in a state in which the reference pin is inserted, assembling process of the frame assembly may be simplified, and productivity improved.

Further, as the assembling process of the frame assembly is simplified so that the plurality of coupling members are coupled at once, automation of the assembling process may be easily realized. Furthermore, as the plurality of coupling members are coupled at once, twisting or deformation of the fixed scroll or the main frame during the assembling process may be prevented.

Embodiments disclosed herein provide a scroll compressor in which a main frame and a fixed scroll may be easily assembled with each other.

Embodiments disclosed herein provide a scroll compressor that may include a casing including a rotational shaft; a main frame coupled to an inside of the casing; a first scroll that revolves due to rotation of the rotational shaft, the first scroll being supported by the main frame; and a second scroll disposed on or at a side of the first scroll to define a plurality of compression chambers together with the first scroll. The second scroll may include a head plate including a wrap and a coupling guide part or guide that extends from the head plate. The coupling guide part may include a first reference pin coupling hole, into which a reference pin may be inserted, and a guide hole, into which a coupling member may be inserted.

The main frame may include a main body, and a frame guide that extends from the main body. The frame guide may include a second reference coupling hole, into which the reference pin may be inserted, and a frame guide hole, into which the coupling member may be inserted. A plurality of the coupling guide part may be provided, and the plurality of coupling guide parts may be spaced apart from each other. A plurality of the frame guide part may be provided to correspond to the plurality of coupling guide parts.

The plurality of coupling guide parts may include a first coupling guide part or guide having a first guide hole, into which a first coupling member may be inserted, and a second coupling guide part or guide having a second guide hole, into which a second coupling member may be inserted and the first reference pin coupling hole. The plurality of frame guide parts may include a first frame guide part or guide having a first frame guide hole, into which the first coupling member may be inserted, and a second frame guide part or guide having a second frame guide hole into which the second coupling member may be inserted and the second reference pin coupling hole.

The coupling guide part may protrude outward from the head plate of the fixed scroll. The frame guide part may protrude outward from the main body of the main frame.

The scroll compressor may further include a guide pin that surrounds a lower portion of the coupling member. The guide pin may pass through the guide hole of the second scroll and be supported by an upper portion of the main frame.

Embodiments disclosed herein further provide a method for assembling a scroll compressor that may include disposing a second scroll on a main frame; inserting a reference pin into the main frame and the second scroll; coupling a plurality of coupling members to the main frame and the second scroll; and separating the reference pin from the main frame and the second scroll in a state in which the plurality of coupling members are coupled. The disposing of the second scroll on the main frame may include aligning a plurality of frame guide parts or guides formed on the main frame with a plurality of coupling guide parts or guides formed on the second scroll. The plurality of frame guide parts may protrude outward from the main frame, and the plurality of coupling guide parts may protrude outward from a second head plate of the second scroll.

One coupling guide part of the plurality of coupling guide parts may include a first reference pin coupling hole, into which the reference pin may be inserted, and a guide hole, into which the coupling member may be inserted. At least one frame guide part of the plurality of frame guide parts may include a second reference pin coupling hole, into which the reference pin may be inserted, and a frame guide hole, into which the coupling member may be inserted.

The inserting of the reference pin into the main frame and the second scroll may include inserting a plurality of reference pins into the main frame and the second scroll. The coupling of the plurality of coupling members to the main frame and the second scroll may include inserting the coupling members into the guide hole in a state in which the reference pin is coupled to the first reference pin coupling hole. The coupling of the plurality of coupling members to the main frame and the second scroll may include inserting the coupling members into the frame guide hole in a state in which the reference pin is coupled to the second reference pin coupling hole.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing including a rotational shaft;

a main frame coupled to an inside of the casing;

an orbiting scroll revolved by rotation of the rotational shaft, the orbiting scroll being supported by the main frame; and a fixed scroll provided on or at a side of the orbiting scroll to define a plurality of compression chambers together with the orbiting scroll, wherein the fixed scroll includes:

a head plate including a wrap and an outer peripheral surface; and at least one scroll protrusion that protrudes outward in a radial direction from the outer peripheral surface of the head plate, wherein the at least one scroll protrusion includes both a first reference pin coupling hole, into which a reference pin is inserted, and a guide hole, into which a screw is inserted, wherein the reference pin is removed from the first reference pin coupling hole after the fixed scroll and the main frame are assembled, wherein the main frame includes a main body and at least one frame protrusion that protrudes outward in a radial direction from an outer peripheral surface of the main body, and wherein the at least one frame protrusion includes a second reference pin coupling hole, into which the reference pin is inserted, and a frame guide hole, into which the screw is inserted.

2. The scroll compressor according to claim 1, wherein the at least one scroll protrusion includes a plurality of scroll protrusions, and wherein the plurality of scroll protrusions is spaced apart from each other.

3. The scroll compressor according to claim 2, wherein the at least one frame protrusion includes a plurality of frame protrusions corresponding to the plurality of scroll protrusions.

4. The scroll compressor according to claim 3, wherein the plurality of scroll protrusions includes:

a first scroll protrusion having a first coupling guide hole, into which a first screw is inserted; and a second scroll protrusion having a second coupling guide hole, into which a second screw is inserted.

5. The scroll compressor according to claim 4, wherein the plurality of frame protrusions includes:

a first frame protrusion having a first frame guide hole, into which the first screw is inserted; and a second frame protrusion having a second frame guide hole, into which the second screw is inserted.

6. The scroll compressor according to claim 5, wherein the first screw passes through the first coupling guide hole and is screw-coupled to the first frame guide hole, and wherein the second screw passes through the second coupling guide hole and is screw-coupled to the second frame guide hole.

7. The scroll compressor according to claim 1, further including a guide pin that surrounds a lower portion of the screw, wherein the guide pin passes through the guide hole of the scroll and is supported by an upper portion of the main frame.

8. The scroll compressor according to claim 1, wherein the reference pin passes through the first reference pin coupling hole and is inserted into the second reference pin coupling hole of the main frame.

9. The scroll compressor according to claim 1, further including a cover that partitions an inner space of the casing into a suction space and a discharge space.

10. The scroll compressor according to claim 9, wherein the casing includes a suction port that communicates with the suction space and a discharge port that communicates with a discharge space.

11. The scroll compressor according to claim 10, wherein the fixed scroll includes a discharge hole provided in approximately a central portion of the head plate through which a refrigerant compressed in the plurality of compression chambers is discharged into the discharge space.

12. The scroll compressor according to claim 10, wherein the fixed scroll includes a suction hole through which the refrigerant to be compressed in the plurality of compression chambers is introduced into the plurality of compression chambers from the suction space.

13. The scroll compressor according to claim 12, wherein the suction hole is provided in a side surface of the fixed scroll.

14. A method for assembling a scroll compressor, the method comprising:

supporting an orbiting scroll on a main frame;

disposing a fixed scroll on the main frame to define a plurality of compression chambers together with the orbiting scroll;

inserting at least one reference pin into the main frame and the fixed scroll;

coupling a plurality of screws to the main frame and the fixed scroll; and separating the at least one reference pin from the main frame and the fixed scroll in a state in which the plurality of screws is coupled, wherein the fixed scroll includes:

a head plate including a wrap and an outer peripheral surface; and at least one scroll protrusion that protrudes outward in a radial direction from the outer peripheral surface of the head plate, wherein the at least one scroll protrusion includes both a first reference pin coupling hole, into which the reference pin is inserted, and a guide hole, into which a screw of the plurality of screws is inserted, wherein the reference pin is removed from the first reference pin coupling hole after the fixed scroll and the main frame are assembled, wherein the main frame includes a main body and at least one frame protrusion that protrudes outward in a radial direction from an outer peripheral surface of the main body, and wherein the at least one frame protrusion includes a second reference pin coupling hole, into which the reference pin is inserted, and a frame guide hole, into which the screw of the plurality of screws is inserted.

15. The method according to claim 14, wherein the at least one scroll protrusion includes a plurality of scroll protrusions, wherein the at least one frame protrusion includes a plurality of frame protrusions, and wherein the disposing the fixed scroll on the main frame includes aligning the plurality of frame protrusions formed on the main frame with the plurality of scroll protrusions formed on the fixed scroll.

16. The method according to claim 14, wherein the coupling of the plurality of screws to the main frame and the fixed scroll includes inserting the plurality of screws into the frame guide hole in a state in which the reference pin is coupled to the at least one first reference pin coupling hole.

17. The method according to claim 16, wherein the coupling of the plurality of screws to the main frame and the fixed scroll includes inserting the plurality of screws into the plurality of frame guide holes in a state in which the reference pin is coupled to the second reference pin coupling hole.

18. The method according to claim 14, wherein the inserting the at least one reference pin into the main frame and the fixed scroll includes inserting a plurality of reference pins into the main frame and the fixed scroll.

* * * * *